US006367624B1

(12) United States Patent
Szczepanski et al.

(10) Patent No.: US 6,367,624 B1
(45) **Date of Patent: *Apr. 9, 2002**

(54) OPTICAL COMPONENT PACKAGING

(75) Inventors: Paul W. Szczepanski, Matthews; David J. Monks, Charlotte, both of NC (US)

(73) Assignee: Northrop Grumman Corporation, Los Angeles, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/172,240

(22) Filed: Oct. 14, 1998

(51) Int. Cl.[7] ..... B65D 85/38
(52) U.S. Cl. ..... 206/305; 206/443; 206/446
(58) Field of Search ..... 206/305, 306, 206/446, 443

(56) References Cited

U.S. PATENT DOCUMENTS

| | | | | | |
|---|---|---|---|---|---|
| 3,819,081 | A | * | 6/1974 | Runte | 220/17 |
| 4,450,965 | A | * | 5/1984 | Paillet | 206/528 |
| 4,815,622 | A | * | 3/1989 | Cramer | 220/4 B |
| 4,834,239 | A | * | 5/1989 | Osgood | 206/418 |
| 4,842,134 | A | * | 6/1989 | Chang | 206/315.1 |
| 5,022,518 | A | * | 6/1991 | Therrien | 206/0.82 |
| 5,165,537 | A | * | 11/1992 | Neff | 206/315.1 |
| 5,209,352 | A | * | 5/1993 | Light | 206/391 |
| 5,248,030 | A | * | 9/1993 | Tarozzi | 206/1.7 |
| 5,279,097 | A | * | 1/1994 | Weisburn | 53/449 |
| 5,515,971 | A | * | 5/1996 | Segrest | 206/418 |
| 5,572,541 | A | * | 11/1996 | Suni | 372/70 |
| 5,788,069 | A | * | 8/1998 | Calhoun | 206/312 |
| 5,805,625 | A | * | 9/1998 | Langer | 372/35 |
| 6,173,834 | B1 | * | 1/2001 | Voden | 206/315.1 |

* cited by examiner

*Primary Examiner*—James W. Davie
*Assistant Examiner*—Gioacchino Inzirillo
(74) *Attorney, Agent, or Firm*—Lowe Hauptman Gilman & Berner, LLP

(57) ABSTRACT

Disclosed is an optical component packaging assembly including a rectangular plastic box with an upper half and a lower half. In the lower half, a thermal plastic vacuum formed insert is positioned within the lower half. The lower insert has a recess. The recess has opposed convex ends and central finger recesses. The opposed convex ends prevent the end faces of the optical component from being brought into contact with the insert. The convex ends may be v-shaped or semi-circular. The finger recesses provide convenient access to the laser rod so that the person unpackaging the laser rod from the optical component packaging is most likely to engage the laser rod at a center portion thereof rather than grasping the laser rod at the end faces thereof, thereby inadvertently damaging the optical surfaces of the laser rod. When the optical component packaging box is closed, a downwardly extending portion from an insert placed in the upper half of the box engages the outer diameter of the laser rod and secures the laser rod in position in the recess.

24 Claims, 4 Drawing Sheets

FIG. 1
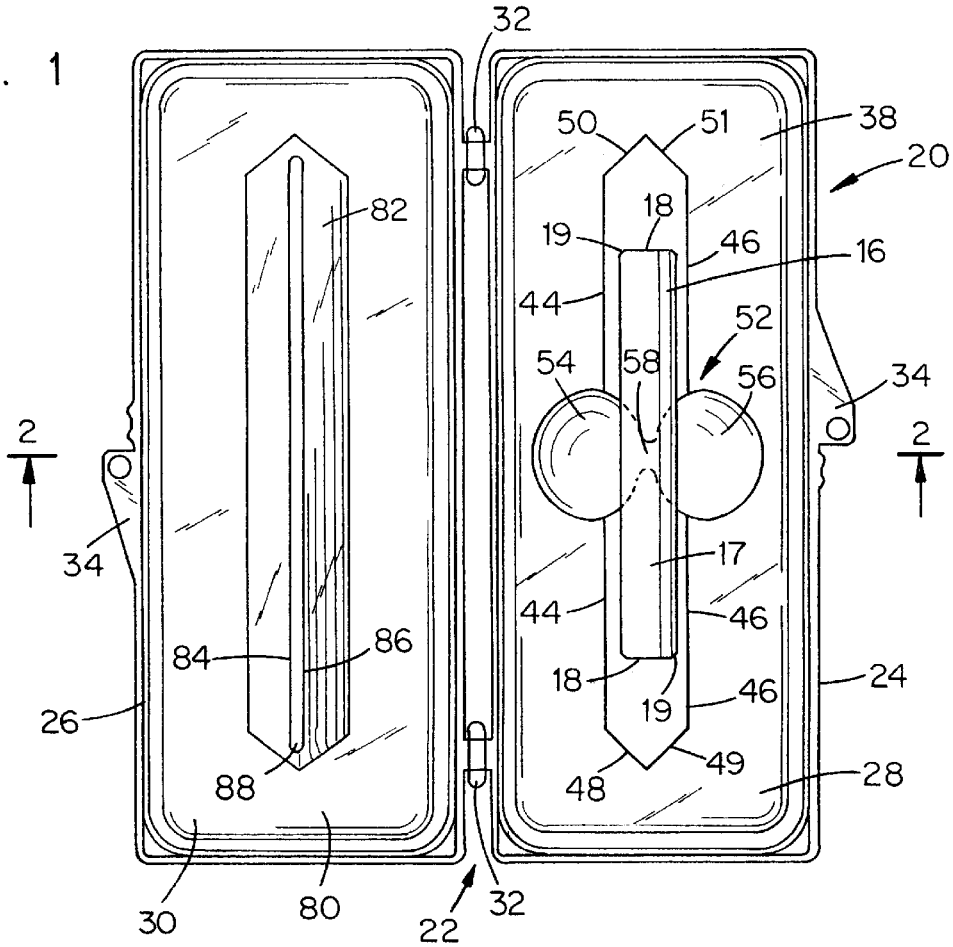
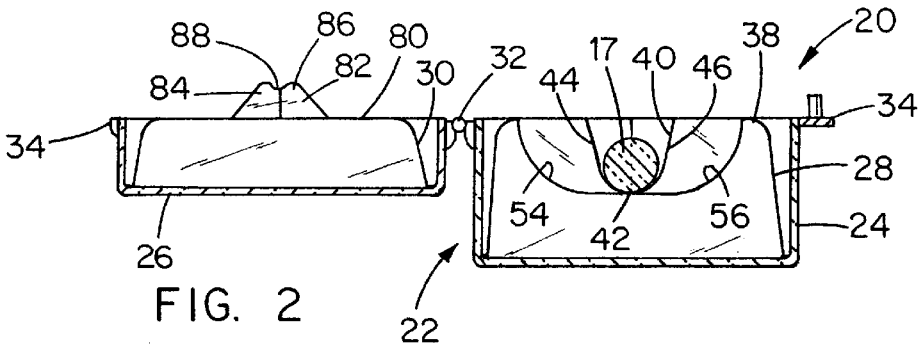
FIG. 2
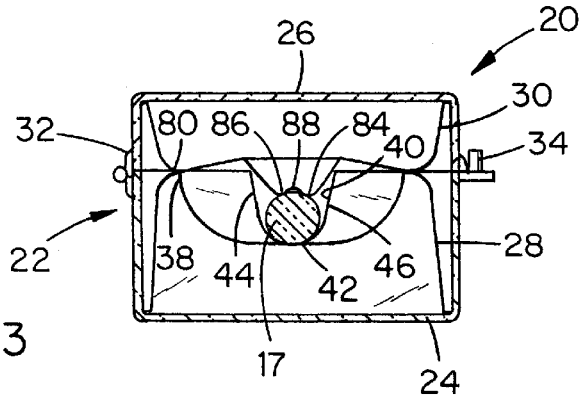
FIG. 3

FIG. 6
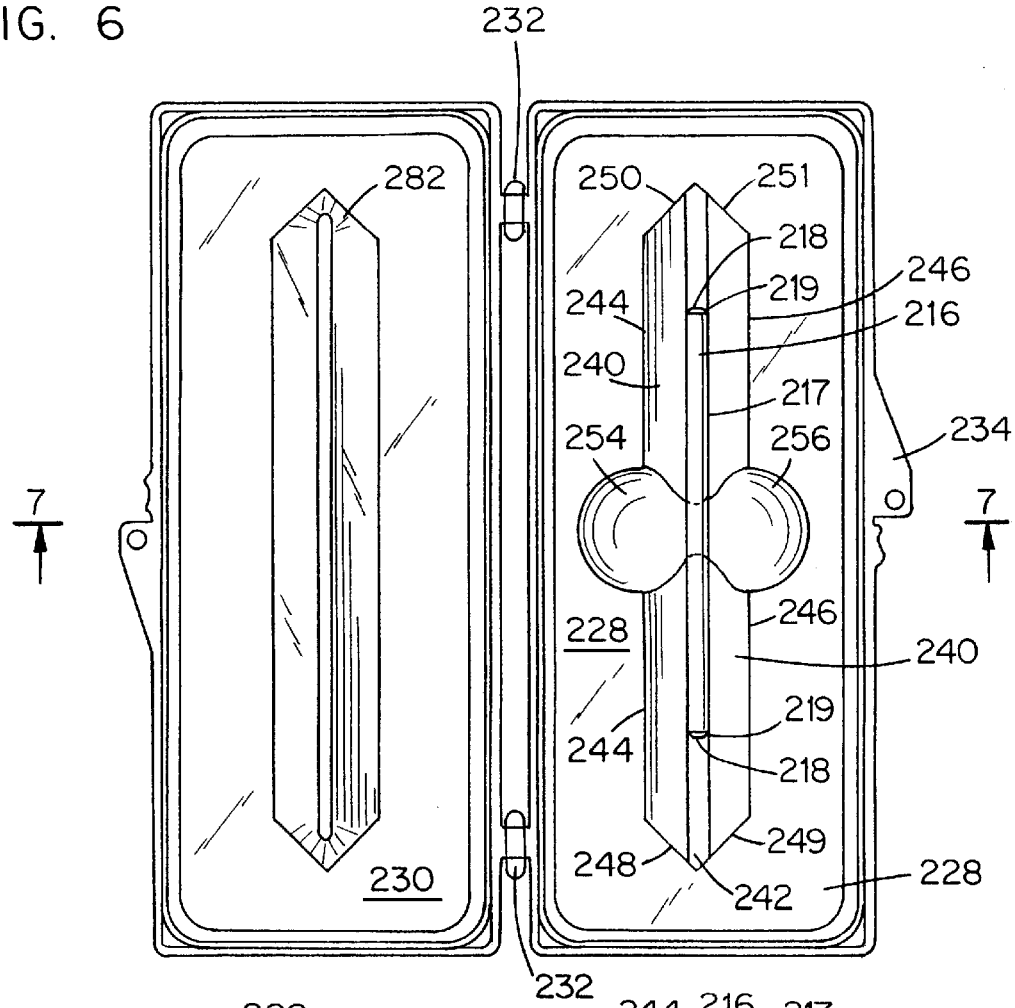
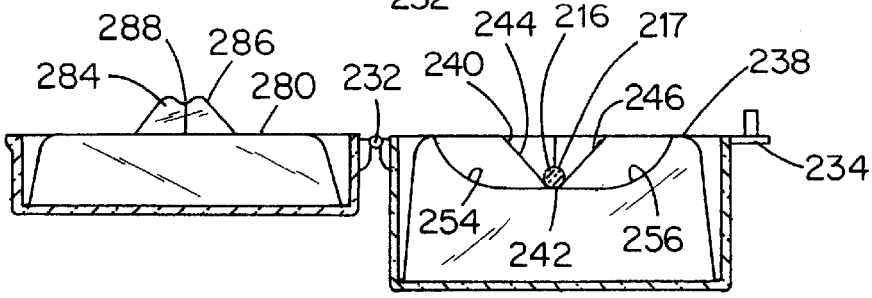
FIG. 7
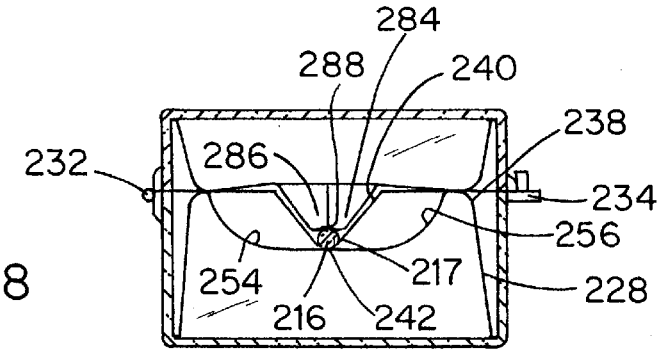
FIG. 8

OPTICAL COMPONENT PACKAGING

RELATED APPLICATION

The present application is related to the design application entitled "Optical Component Packaging", now U.S. Pat. No. Des. 417,391 filed herewith on even date, and assigned to the instant assignee.

FIELD OF THE INVENTION

The present invention relates generally to optical component packaging, and more particularly, to optical component packaging for optical laser rods.

BACKGROUND OF THE INVENTION

Most solid-state industrial laser systems made today include a laser rod of neodymium-doped yttrium aluminum garnet (Nd:YAG). Nd:YAG was one of the early materials laser pioneers tried thirty years ago and is merely a representative example of the materials from which laser rods can be manufactured. It is a versatile material that can be operated effectively in either pulsed or continuous wave modes. A combination of factors make Nd:YAG the practical material of choice for high average power solid-state lasers today and for the foreseeable future.

The laser rods typically have end surfaces that have been polished flat to within one-tenth of the wave length of light and have been coated with a material to prevent reflection losses. Usually lasers with rated average output power up to 500 W use a single cylindrical rod up to 10 mm diameter by 150 mm long. Higher-power systems with rated outputs of 2–3 kw can have up to four, or less-commonly six, pump heads, each with a single cylindrical rod up to 200 mm or more long. More recently, rectangular slab configuration crystals with up to 10 mm by 25 mm cross-sectional dimensions and lengths in excess of 200 mm have been sold.

These laser rods are synthetically grown and are quite expensive. The yield from a synthetically grown crystal is quite small because the crystal's exhibit fine grain-like striations which are formed as successive layers of materials solidify on the conical-shaped growth interface during the long growth cycle. Any light propagating parallel or even at some small angle to these striations experiences strong distortions.

The growth of high-quality in Nd:YAG crystals is a rather expensive undertaking because the process is very slow, requiring a very stable environment to be successful. The facet and striation features of the crystal morphology unavoidably limit the material yield. Consequently, the laser rod crystal, especially a slab crystal, is one of the more expensive components in a laser system.

In spite of the high cost of fabrication of the laser rods, the laser rods frequently are damaged in shipping from the laser rod supplier to laser manufacturer, while positioned in a plastic container. The end surfaces of the laser rods have to be protected during shipment. The end surfaces are coated and are very sensitive to damage. The microstructure of the coating is porous and can become contaminated by out-gassing or by the adhesive of particulates. To eliminate this contamination, cleaning steps are required to remove such contaminants. Normally, laser rods are shipped in lens tissue with the laser rod then being packaged in the plastic container having a foam insert with a channel to receive the laser rod packed in the lens tissue. The lens tissue is in itself "dirty" in that it contains particulates which can adversely affect the cleanliness of the end faces of a laser rod and since lens tissue has been bleached, the bleaching process also makes it susceptible to out-gassing, which further adversely affects the cleanliness of the end faces of the laser rod. In addition, the lens tissue can trap dirt which can be transferred from the lens tissue to the laser rod during the handling process. The lens tissue tends to leave dirt on the end faces of the laser rod. This requires that the rod have its end faces cleaned prior to use. Cleaning requires an additional process before the rod can be used and raises the possibility of scratching the delicate coatings applied to the end faces. In addition, the use of foam to hold the laser rod in the plastic shipping container introduces the possibility that out-gassing from the foam will introduce contaminants onto the end faces of the laser rod.

Frequently, the laser rod will shift within the plastic container and the end faces can be damaged if an end face is brought into contact with the plastic container. Also, during removal from the plastic container, the end faces of the laser rod can be touched by human hands and become damaged and not usable. To prevent the end faces from becoming damaged, protective material (lens tissue, foam) is frequently put on the end faces and warning labels are placed on the packaging to warn the person removing the laser rod from the packaging not to touch the end faces of the laser rod. Despite such warnings and protective measures being taken, the laser rods may nevertheless be damaged when being removed from packaging material. Accordingly, a need exists in the art for a packaging in which the laser rod is protected during shipment and the possibility of the laser rod being damaged during removal from packaging is minimized.

SUMMARY OF THE INVENTION

It is, therefore, an object of the present invention to provide packaging for an optical component in which the possibility of damage to the optical component when removed from the optical component packaging is minimized.

It is a further object of the present invention to provide optical component packaging in which the possibility of damage of the end faces of the optical component are minimized during removal from the optical packaging.

It is yet a further object of the present invention to provide optical packaging which protects the optical component during transport and which is inexpensive to produce.

These and other objects of the present invention are achieved by providing an optical component packaging assembly including a rectangular plastic box with an upper half and a lower half. The optical component has at least one optical surface that needs to be protected. A thermal plastic vacuum formed insert is positioned within the lower half. The lower insert has a recess. The recess has opposed v-shaped or semi-circular ends and central finger recesses. The opposed v-shaped or semi-circular ends prevent the end faces (optical surfaces) of the optical component from being brought into contact with the insert. The finger recesses provide convenient access to the laser rod so that the person unpackaging the laser rod from the optical component packaging is most likely to engage the laser rod at a center portion thereof rather than grasping the laser rod at the end faces thereof, thereby inadvertently damaging the optical surfaces of the laser rod. When the optical component packaging box is closed, a downwardly extending portion from an insert placed in the upper half of the box engages the outer diameter of the laser rod and secures the laser rod in position in the recess.

The foregoing objects are also achieved by a container for holding at least one laser rod. The container includes a container body and an insert located within the container body. The insert has at least one elongated recess. Each of the at least one recess has opposed convex ends. The at least one laser rod is positionable in the recess.

The foregoing objects are also achieved by a container for holding at least one laser rod. The container includes a container body and an insert located within the container body. The insert has at least one elongated recess. Each of the at least one recess has opposed convex ends. The at least one optical component is positionable in said recess.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein:

FIG. 1 is a top plan view of the optical component packaging with the optical component packaging being depicted in an open position with an optical component located in one-half thereof;

FIG. 2 is a side elevational view of the optical component packaging of FIG. 1 taken along line 2—2 with the optical component packaging being depicted in an open position;

FIG. 3 is a side elevational view of the optical component packaging being depicted in a closed position;

FIG. 6 is a top plan view of a third embodiment of the optical component packaging according to the present invention with the optical component packaging being depicted in an open position;

FIG. 7 is a side elevational view of the optical component packaging taken along line 7—7 of FIG. 6 being depicted in an open position; and FIG. 8 is a side elevational view of the optical component packaging of FIG. 6 depicted in a closed position.

BEST MODE FOR CARRYING OUT THE INVENTION

Figure 4:
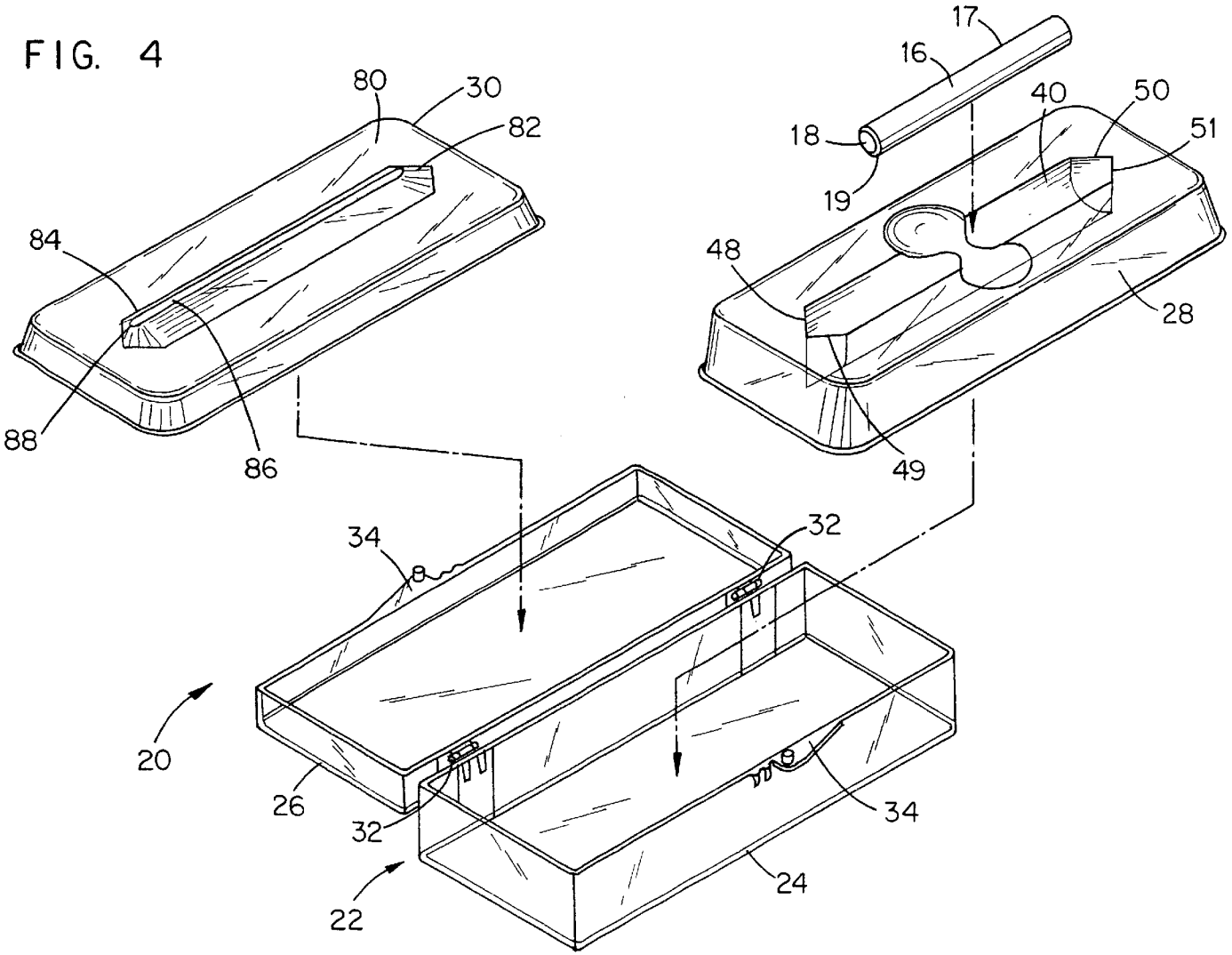
FIG. 4 is an exploded perspective view of the optical component packaging of FIG. 1.

An article for packaging an optical component, such as a laser rod, according to the present invention, are described. Other optical components having surfaces which can be easily damaged can also be positioned in the optical component packaging according to the present invention. For convenience, the invention will be described with respect to the orientations depicted in FIGS. 1, 5 and 6 and consequently, terms such as "left", "right", "upper", and "lower" are to be construed in the relative sense.

Referring to FIGS. 1–8, various embodiments of the present invention are illustrated, each embodiment having a different number in the tens and hundreds digits. Accordingly, there is a "10 series", a "100 series" and a "200 series".

FIG. 1 depicts the optical component packaging 20 into which a cylindrical laser rod 16 is placed. The laser rod 16 has a cylindrical outer surface 17, opposed flat end surfaces 18 and opposed chamfers 19 extending between the outer surface 17 and a respective end face or surface 18. The end faces 18 are polished flat to within one-tenth of the wave length of light and are coated with a material to prevent reflection losses. The laser rod 16 may be made from the previously described Nd:YAG material, or from other known single-crystal laser materials which can take advantage of the attributes of the packaging according to the present invention.

The optical component packaging 20 includes a plastic container 22 which is usually transparent or translucent and which has a lower half 24 and upper half 26. Positioned within the lower half 24 is a lower insert 28 which is made by vacuum molding. Positioned within the upper half 26 is a vacuum-formed upper insert 30. Both inserts 28, 30 can be made from a clear or transparent material and are flexible. Alternatively, the lower insert 28 and upper insert 30 can be manufactured as a single insert or from several pieces as is known. The lower half 24 and the upper half 26 are joined by a pair of conventional hinges 32 which are mounted on a longitudinal surface of the lower half 24 and the upper half 26, allowing the upper half 26 to pivot relative to the lower half 24, as depicted in FIG. 1. In FIGS. 1 and 2 the lower half 24 and the upper half 26 are illustrated in an open position. A conventional locking mechanism 34 which is mounted to an opposite longitudinal surface of the lower half 24 and the upper half 26 is a snap fit locking mechanism allowing the optical component packaging 20 to be brought into a closed and locked position as depicted in FIG. 3.

Referring back to FIGS. 1–4, the laser rod 16 is illustrated as being positioned within a recess 40 which extends below an outer surface 38 of lower insert 28. Recess 40 has a lower semi-cylindrical surface 42 as illustrated in FIGS. 2 and 3. Extending upwardly from lower semi-cylindrical surface 42 to the outer surface 38 is a flat left surface 44 and a right flat surface 46. Each surface 44, 46 extends at an angle from surface 42 as depicted in FIG. 2 so that recess 40 is larger at upper surface 28 than at surface 42. Recess 40 has a v-shaped end having surfaces 48 and 49 and an opposite end having surfaces 50 and 51. A finger recess generally indicated at 52 is located at a central portion of the recess 40 and includes a first half finger recess 54 and a second half finger recess 56. The first half of finger recess 54 is centrally located relative to left surface 44 and the second half finger recess 56 is centrally located relative to right surface 46. The first half finger recess 54 and second half finger recess 56 extend inwardly from respective surfaces 44, 46 and outwardly beyond the respective surfaces 44, 46 so that fingers can be inserted therein to grasp the outer surface. Surfaces 44 and 46 are interrupted by finger recesses 54, 56. Surface 44 extends from end surface 50 as depicted in FIG. 1 and terminates at surface 48. Surface 46 extends from end surface 51 and terminates at surface 49.

As depicted in all of the figures, the optical component packaging 20 has a container 22 that is depicted as being of a rectangular configuration. It should be understood that any configuration other than rectangular could also be used.

The laser rod 16 is depicted as being cylindrical. Although a cylindrical configuration is most common, it should be understood that other configurations can also be used with the present invention such as a square cross-section, a rectangular cross-section and other cross-sections. The recess 40 need only be configured to mate with the outer surface of the laser rod 16 (other than the end faces 18) for the present invention to function. Further, although depicted as having a uniform outside diameter, the laser rod 16 can have non-uniform outside diameter. Further, the invention is not only limited to the use of optical components such as laser rods but any optical component in which one or more surfaces needs to be protected from damage during shipment and removal from the packaging after shipment can be used.

The recess 40 is shaped to capture the laser rod 16 without any contact between the surfaces of the recess 40 and the end surfaces 18 of the laser rod 16. Left surface 44 and right surface 46 are spaced apart to hold various diameters and lengths of laser rod 16. The laser rod 16 has chamfers 19 which prevent the outside diameter of end surface 18 from touching left surface 44, right surface 46 and lower semi-cylindrical surface 42. The end surfaces 48, 49 and end surfaces 50, 51 are spaced from end surfaces 18 to prevent end surfaces 18 from touching surfaces 48, 49, 50, 51. Once the upper half 26 is closed, the laser rod 16 will be prevented from moving in a longitudinal direction of the optical component packaging 20 and will be kept centered within the recess. The laser rod 16 is shorter in the longitudinal direction than the recess 40. The recess 40 is sized to accept laser rod 16. Even if the laser rod 16 should slide in the longitudinal direction during shipment, the v-shaped ends 48, 49, 50, 51 will prevent end faces 18 from coming into contact with v-shaped ends 48, 49, 50, 51.

The upper insert 30 is mounted within rectangular upper half 26 in a conventional manner. The upper insert 30 has an outer surface 80 and extends outwardly from outer surface 80 is an outwardly extending portion 82 having a first raised ridge 84 and a second raised ridge 86 separated by an indented portion 88.

As depicted in FIG. 3, when the upper half 26 is brought into a closed position and the locking mechanism 34 is locked, outer surface 38 and outer surface 80 are brought into contact with one another. The outwardly extending portion 82 is brought into contact with the outer diameter 17 of the laser rod 16 and is slightly compressed and deformed when engaged with the laser rod 16. This compressive force keeps the laser rod 16 centered in the recess 40 and prevents movement during shipping. The first and second raised ridges 84, 86 serve to capture and mate with the outer diameter 17. Portion 82 is configured to form a small gap between the surfaces of portion 82 and recess 40 which prevents movement of the laser rod 16.

The previously described optical component packaging 20 advantageously captures and secures the laser rod 16 during shipment without any contact occurring between end surfaces 18 and any other object. Each packaging 20 will accommodate various lengths and diameters of laser rods 16. Further, advantageously, the finger recesses 54, 56 make it easy and convenient for a person to remove the laser rod 16 from the optical component packaging 20 by grasping the laser rod 16 in the center thereof rather than attempting to grasp the end surfaces 18 thereof and cause damage to the laser rod 16.

Figure 5:
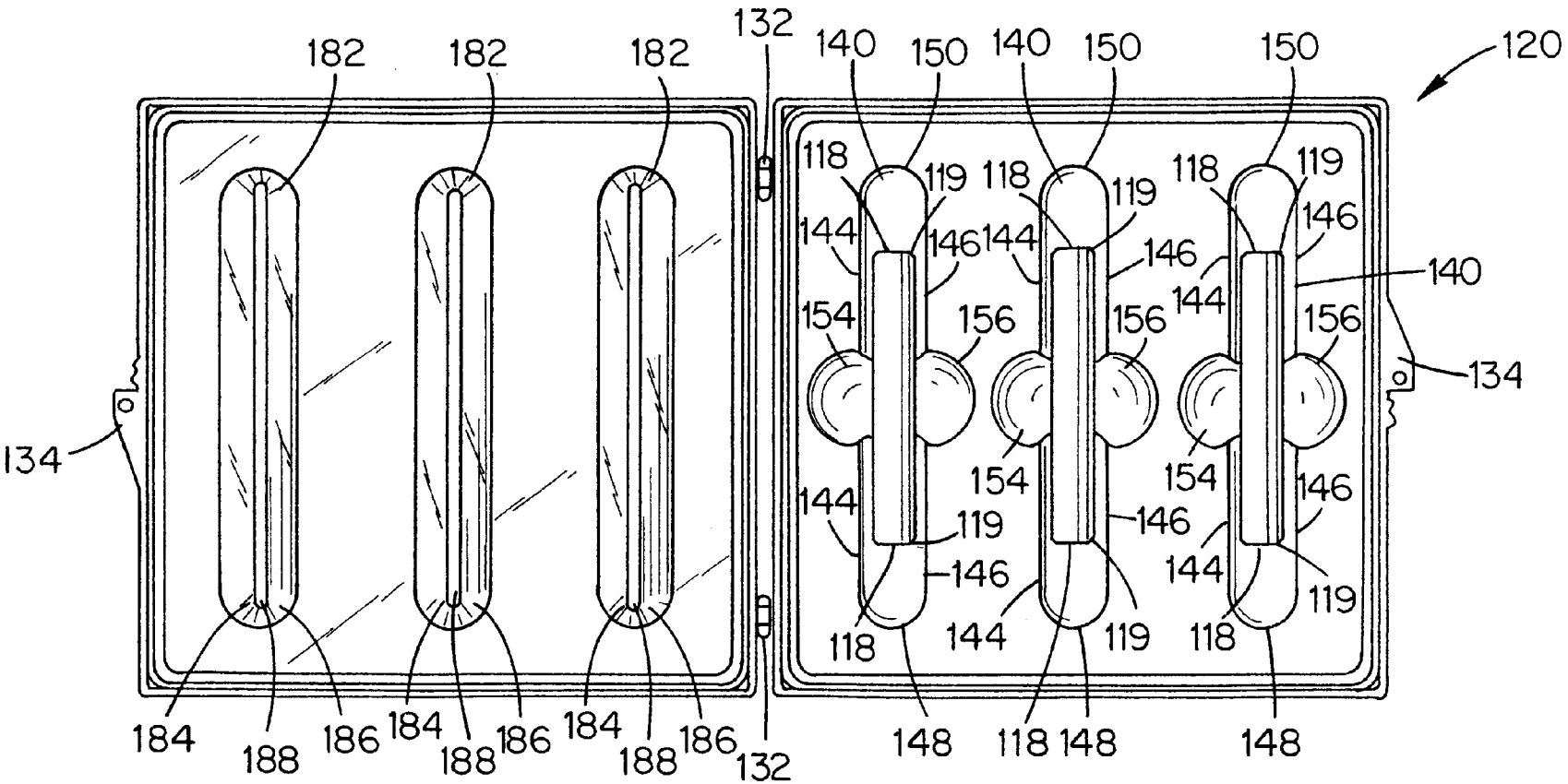
FIG. 5 is a top plan view of a second embodiment of the optical component packaging according to the present invention depicted in an open position for holding three optical components.

In FIG. 5, a second embodiment of the present invention is depicted in which three laser rods 116 are depicted in three separate recesses 140. The other reference numerals having "100" series designations need not be described here, as the reference numerals have been previously described with respect to the first embodiment, the only differences being that the optical component packaging of FIG. 5 can accept three laser rods and instead of v-shaped ends having surfaces 48, 49, 50, 51, there are semi-circular end surfaces 148, 150. All described embodiments can have either v-shaped, semi-circular or other convex configurations which prevent end faces 18 from contacting the end surfaces. The number of laser rods to be accommodated by a particular optical component packaging depends on the number of laser rods required by a particular laser. It is to be understood that the optical component packaging according to the present invention can be modified to accommodate any number of optical laser rods.

In FIG. 6, a third embodiment of the present invention is illustrated having a smaller diameter laser rod 216. The smaller diameter laser rod requires a slightly different configuration for the recess than that disclosed for the larger diameter laser rod 16 in FIGS. 1–3. To accommodate the smaller laser rod 216, a v-shaped groove, depicted in FIGS. 7–8, is better suited to secure the laser rod 216 in recess 240. Recess 240 includes a very small curved portion 242 and two flat walls 244, 246 which extend between top surface 238 and curved portion 242 at an angle such that the opening at surface 238 is larger than the curved portion 242. The other reference numerals having "200" series designations need not be described here, as the reference numerals have been previously described with respect to the first embodiment, the only difference being that the optical component packaging of FIGS. 6–8 has a different recess 240 configuration.

Advantageously, the present invention eliminates the need to package the laser rod in lens tissue. The present invention eliminates the need to clean the dirt left on optical surfaces by the lens tissue.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A packaging container for holding at least one laser rod, said at least one laser rod having an elongated shape extending along an axis with two axially opposed ends, each axially opposed end having a planar surface and both planar surfaces are parallel to each other, said packaging container comprising:

a container body forming an exterior of said packaging container;

an insert located within said container body, said insert having at least one elongated recess, extending along an axis, each of said at least one recess having axially opposed convex ends, the at least one laser rod positionable in said recess such that each end of the at least one laser rod faces and is spaced from a convex end of the at least one recess, the at least one laser rod being removable therefrom to be placed in a laser rod apparatus.

2. The packaging container of claim 1, wherein said container body includes an upper half and a lower half connected by a hinge, said container body having an open position where said at least one laser rod can be accessed and a closed position where said at least one laser rod is captured in said recess.

3. The packaging container of claim 2, wherein said insert includes an upper half mounted in said container body upper half and a lower half mounted in said container body lower half, a portion of said insert upper half being urged into the at least one laser rod thereby capturing the at least one laser rod in said recess.

4. The packaging container of claim 1, wherein said recess extends at an angle from a portion thereof to an outer surface thereof.

5. The packaging container of claim 1, wherein each of said at least one recesses has a longitudinal length greater than the length of the at least one laser rod.

6. The packaging container of claim 1, wherein said opposed convex ends are v-shaped.

7. The packaging container of claim 1, wherein said opposed convex ends are semi-circular.

8. The packaging container of claim 1, wherein said insert has finger grip recesses located on opposite sides of each of said recesses.

9. The packaging container of claim 1, wherein the at least one recess is symmetrical in the transverse direction and the longitudinal direction.

10. The packaging container of claim 4, wherein the recess secures the laser rod by engaging an outer diameter along two portions of the laser rod along portions of said recess without end faces of the laser rod being in contact with any portion of the container.

11. The packaging container of claim 1, wherein the at least one laser rod is cylindrical.

12. The packaging container of claim 1, wherein each of the at least one laser rods has a face at opposite ends thereof, each of the faces being kept out of contact with said insert.

13. A packaging container for holding at least one optical component, said at least one optical component having an elongated shape extending along an axis with two axially opposed ends, each axially opposed end having a planar surface and both planar surfaces are parallel to each other, said packaging container comprising:

a container body forming an exterior of said packaging container;

an insert located within said container body, said insert having at least one elongated recess, each of said at least one recess having axially opposed convex ends, the at least one optical component positionable in said recess and having ends spaced from said opposed convex ends, the at least one optical component being removable therefrom to be placed in a laser rod apparatus.

14. The packaging container of claim 13, wherein said container body includes an upper half and a lower half connected by a hinge, said container body having an open position where said at least one optical component can be accessed and a closed position where said at least one optical component is captured in said recess.

15. The packaging container of claim 14, wherein said insert includes an upper half mounted in said container body upper half and a lower half mounted in said container body lower half, a portion of said insert upper half being urged into the at least one optical component thereby capturing the at least one optical component in said recess.

16. The packaging container of claim 13, wherein said recess extends at an angle portion thereof to an outer surface thereof.

17. The packaging container of claim 13, wherein each of said recesses has a longitudinal length greater than the length of the at least one optical component.

18. The packaging container of claim 13, wherein said opposed convex ends are v-shaped.

19. The packaging container of claim 18, wherein said opposed convex ends are semi-circular.

20. The packaging container of claim 13, wherein said insert has finger grip recesses located on opposite sides of each of said recesses.

21. The packaging container of claim 13, wherein the at least one recess is symmetrical in the transverse direction and the longitudinal direction.

22. The packaging container of claim 16, wherein the recess secures the laser rod by engaging an outer diameter along two portions of the laser rod along portions of said recess without end faces of the laser rod being in contact with any portion of the container.

23. The packaging container of claim 13, wherein the at least one optical component is a laser rod.

24. The packaging container of claim 13, wherein each of the at least one optical component has an optical surface, said optical surface being kept out of contact with said insert.

* * * * *

UNITED STATES PATENT AND TRADEMARK OFFICE

CERTIFICATE OF CORRECTION

PATENT NO. : 6,367,624 B1 
DATED : April 9, 2002
INVENTOR(S) : Paul W. Szczepanski and David J. Monks It is certified that error appears in the above-identified patent and that said Letters Patent is hereby corrected as shown below:

Title page,
Item [73], Assignee, please replace "Northrop Grumman Corporation, Los Angeles, CA, (US) with -- Litton Systems, Inc., Los Angeles, California, (US) --.

Signed and Sealed this

Twenty-ninth Day of July, 2003

JAMES E. ROGAN
*Director of the United States Patent and Trademark Office*